United States Patent [19]

Mochimaru

[11] Patent Number: 4,605,299

[45] Date of Patent: Aug. 12, 1986

[54] IMAGE FORMING APPARATUS WITH SIZED PROCESSING KITS

[75] Inventor: Hideaki Mochimaru, Yokohama, Japan

[73] Assignee: Ricoh Company, Ltd., Tokyo, Japan

[21] Appl. No.: 767,426

[22] Filed: Aug. 20, 1985

[30] Foreign Application Priority Data

Aug. 28, 1984 [JP] Japan ..... 59-179095

[51] Int. Cl.[4] ..... G03G 15/00

[52] U.S. Cl. ..... 355/3 R; 355/3 DR; 355/3 SH; 355/14 SH; 355/14 R

[58] Field of Search ..... 355/3 R, 3 DR, 3 BE, 355/16, 3 SH, 14 R, 14 SH

[56] References Cited

U.S. PATENT DOCUMENTS

| | | | |
|---|---|---|---|
| 3,880,518 | 4/1975 | Chatfield | 355/3 R X |
| 4,236,807 | 12/1980 | Kuehnle | 355/3 R |
| 4,382,674 | 5/1983 | Miyoshi et al. | 355/3 SH X |
| 4,386,838 | 6/1983 | Hirabayashi et al. | 355/3 DR |
| 4,470,689 | 9/1984 | Nomura et al. | 355/3 R |
| 4,500,195 | 2/1985 | Hosono | 355/3 R |
| 4,551,000 | 11/1985 | Kanemitsu et al. | 355/3 R |
| 4,575,221 | 3/1986 | Onoda et al. | 355/3 R |

*Primary Examiner*—A. C. Prescott

*Attorney, Agent, or Firm*—Oblon, Fisher, Spivak, McClelland & Maier

[57] ABSTRACT

An image forming apparatus for forming an image by means of an image forming kit, or cartridge, which has a photoconductive element built therein. A plurality of replaceable image forming kits are used and each is capable of providing images of a maximum image size which differs from those of the others. The kits are selectively loaded in the apparatus to match with a desired particular image size.

18 Claims, 5 Drawing Figures

IMAGE FORMING APPARATUS WITH SIZED PROCESSING KITS

BACKGROUND OF THE INVENTION

The present invention relates to a copier, printer or like image forming apparatus which is implemented with the principle of electrophotography.

In a modern image forming apparatus of the type described, a plurality of replaceable image forming units, or cartridges, each including at least a photoconductive element therein are selectively loaded in a body of the apparatus as desired. Proposals pertaining to such an apparatus are disclosed in Japanese Unexamined Patent Publication (Kokai) Nos. 58-68759 and 59-77449, for example. The replaceable imge forming unit, or kit, scheme is advantageous from the cost standpoint in consideration of consumption and deterioration in function which occur in various structural elements of each of the kits. Specifically, replacing a deteriorated one of the kits with another is more economical than calling for a serviceman for maintenance and inspection.

However, for most of the users, all the possible sizes of images are not always necessary and, rather, it often suffices to provide for only some particular sizes of images depending upon the user. Concerning an apparatus capable of dealing with images of a B4 format, for example, its function could not be made most of if used to provide images of relatively small sizes such as those for cards, post cards and name cards. Such is wasteful taking into account the costs of the photoconductive element and other essential structural elements. Should the apparatus be reduced in size, on the other hand, images of relatively large sized could not be achieved.

SUMMARY OF THE INVENTION

It is therefore an object of the present invention to provide an economical and waste-saving image forming apparatus which is capable of adapting itself to any desired image size.

It is another object of the present invention to provide a generally improved image forming apparatus.

An image forming apparatus for providing an image on a photoconductive element of the present invention comprises a body which constitutes a housing, and a plurality of image forming kits selectively and removably loaded in the housing for each forming an image of a predetermined maximum size which differs from a predetermined maximum size or sizes assigned to the other kit or kits, each of the kits being provided in a cartridge configuration and including at least a photocondutive element therein.

In accordance with the present invention, an image forming apparatus is disclosed which forms an image by means of an image forming kit, or cartridge, which has a photoconductive elment built therein. A plurality of replaceable image forming kits are used and each is capable of providing images of a maximum image size which differs from those of the others. The kits are selectively loaded in the apparatus to match with a desired particular image size.

The above and other objects, features and advantages of the present invention will become more apparent from the following detailed description taken with the accompanying drawings.

DESCRIPTION OF THE PREFERRED EMBODIMENT

While the image forming apparatus of the present invention is susceptible of numerous physical embodiments, depending upon the environment and requirements of use, a substantial number of the herein shown and described embodiments have been made, tested and used, and all have performed in an eminently satisfactory manner.

Figure 1:
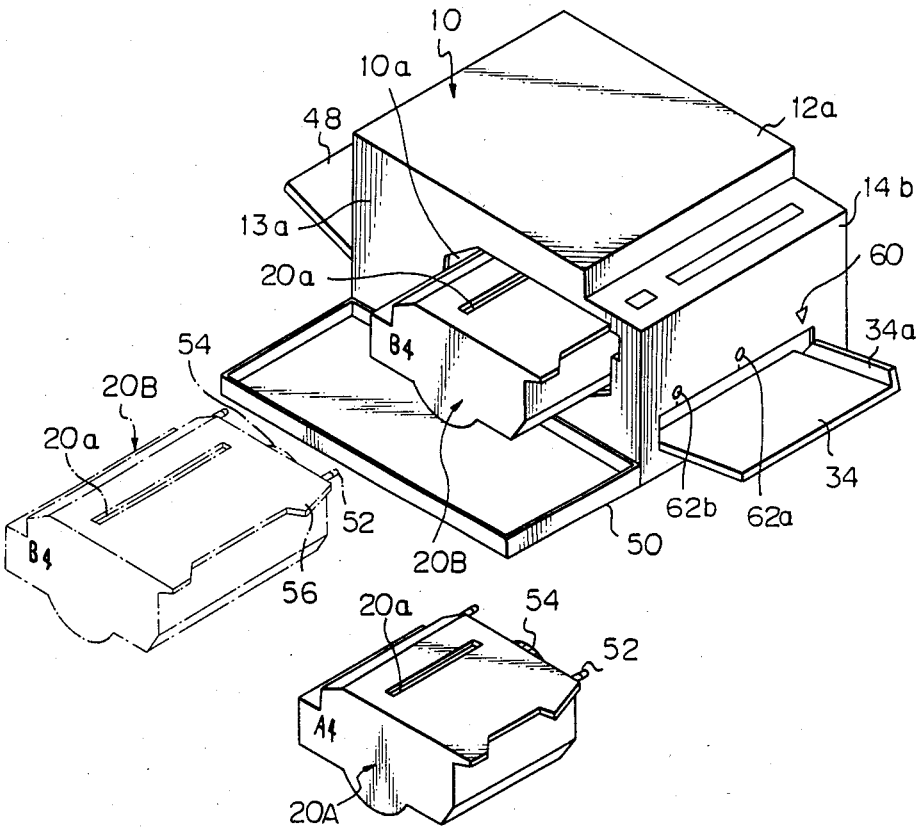
FIG. 1 is a perspective view of an image forming apparatus embodying the present invention.
Figure 2:
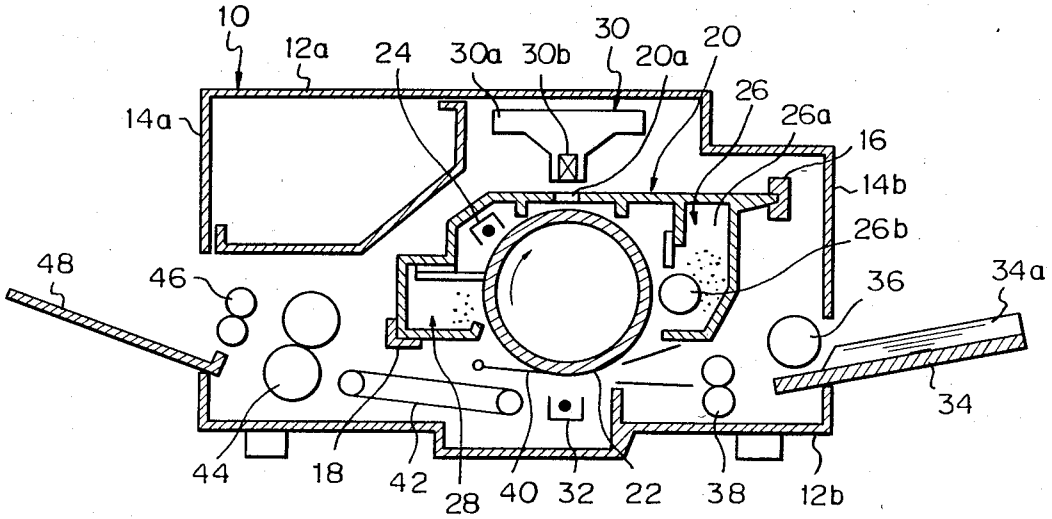
FIG. 2 is a sectional side elevation of the apparatus shown in FIG. 1.

Referring to FIGS. 1 and 2, an image forming apparatus in accordance with the present invention is shown which is applied to an electrophotographic printer by way of example. As shown, the apparatus comprises a housing 10 which is made up of a top wall 12*a*, a bottom wall 12*b*, a front wall 13*a*, a rear wall 13*b* (invisible), a left side wall 14*a*, and a right side wall 14*b*. Guide rails 16 and 18 are each rigidly supported by the front wall 13*a* at one end and by the rear wall 13*b* at the other end, while an image forming kit 20 is removably loaded in the housing 10 guided and supported by the guide rails 16 and 18. The kit 20 includes at least a photoconductive element in the form of a drum 22 therein. In this particular embodiment, a charger 24, a developing unit 26 and a cleaning unit 28 are arranged around the drum 22. The developing unit 26 comprises a hopper 26*a* for storing a developer, and a developing roller 26*b* for supplying toner to the drum 22. While the apparatus of the present invention is operable with any one of a one-component developer which comprises a magnetic toner and a two-component developer which comprises a toner and a magnetic carrier, it in the illustrative embodiment uses the former by way of example. The cleaning unit 28 in the illustrative embodiment is of the type using a blade, but such is not restrictive and the blade may be replaced by a fur brush or used in combination with a fur brush.

An optical writing device 30 is rigidly mounted on the top wall 12*a* of the housing 10 such that it faces the drum 22 through a slit 20*a* which is formed through the image forming kit 20. As shown, the writing device 30 comprises an integral arrangement of a light emitting section 30*a* and an imaging element 30*b*. The light emitting section 30*a* may be implemented by a light emitting diode (LED) array or a fluorescent tube array which is well known in the art, and the light receiving element 30*b* by a bar lens which is commercially available under the trademark of SELFOC.

A transfer charger 32 is located adjacent to the housing bottom wall 12*b* to face the drum 22. Located at the right of the transfer charger 32 as viewed in FIG. 2 are a sheet feed tray 34, a sheet feed roller 36, and a registration roller 38 which are sequentially arranged in this order. The tray 34 is loaded with a stack of sheets 34*a*. Located at the left of the transfer charger 32 are separator means 40, an endless belt 42, a fixing unit 44, a sheet discharge roller 46, and a dicharge tray 48.

In operation, the charger 24 evenly charges the surface of the drum 22 to a predetermined polarity and, then, the optical writing device 30 applies an optical image signal so as to form a latent image electrostatically on the drum 22. The developer 26 develops the latent image to provide a toner image. Meanwhile, a sheet 34*a* fed by the roller 36 out of the tray 34 is driven by the registration roller 38 at a predetermined timing toward a transfer station where the transfer charger 32 is located. Then, the transfer charger 32 transfers the toner image on the drum 22 to the sheet 34*a*. The sheet 34*a* carrying the toner image thereon is separated by the separator means 40 from the drum 22, then transported by the belt 42 to the fixing unit 44 to be fixed thereby, and then discharged by the roller 46 to the tray 48.

As shown in FIG. 1, the image forming kit 20 is loaded in the housing 10 by opening a cover 50 associated with the housing 10 and then pushing the kit 20 into the housing 10 through an opening 10*a*. In this particular embodiment, two kinds of image forming kits 20A and 20B having different dimensions are replaceably used. Specifically, the kits 20A and 20B share the same sectional shape but differ from each other in length along the width of an image. In the illustrative embodiment, the length of the kit 20B is designed for a B4 format and that of the kit 20A for an A5 format by way of example. Positioning pins 52 and a gear 54 for drive transmission are mounted on that end of the kit 20A which will face the rear wall 13*b* of the housing 10 when the kit 20A is loaded in the housing 10. Likewise, positioning pins 52 and a gear 54 which are identical with those of the kit 20A are mouned on the other kit 20B. Any of the kits 20A and 20B, therefore, will be set in the housing 10 when fully pushed into the housing 10 to be positioned by the pins 52. In such a position, the gear 54 will be brought into mesh with a gear (not shown) which is mounted on the housing 10. In this particular embodiment, the housing 10 is constructed to match with a format B4.

In the above construction and arrangement, where it is desired to obtain images having a relatively large width by use of sheets of a B4 or B5 format, the kit 20B will be loaded in the housing 10 to provide images in a B4 format. On the other hand, where relatively small-sized images are desired such as those for cards, postcards and the like, the kit 20A will be loaded in place of the kit 20B to cause the apparatus to fulfill the A5 format function. In this manner, the kits 20A and 20B are selectively usable depending upon the desired image size, that is, small-sized images are obtainable without using the larger kit 20B. Such is cost-effective considering the costs of the photoconductive drum and others.

Figure 3A:
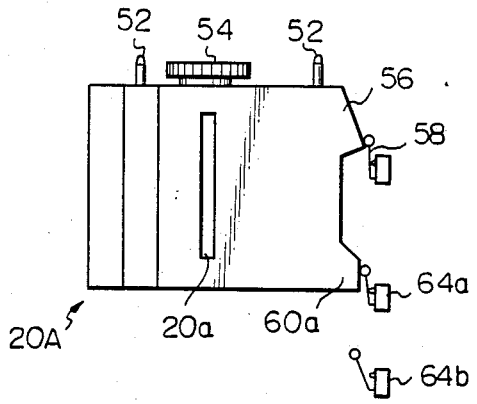
FIGS. 3A and 3B are plan views showing different image forming kits which are selectively loaded in the apparatus of FIG. 1.
Figure 3B:
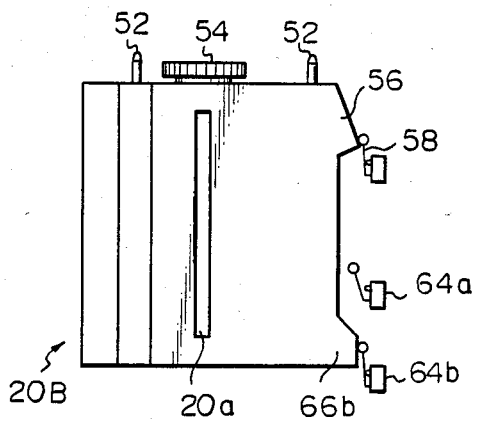
Figure 4:
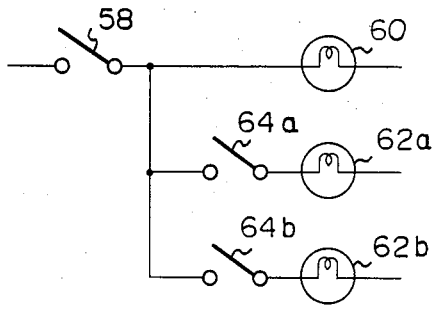
FIG. 4 is a diagram of an electrical circuit associated with the apparatus of FIG. 1.

As shown in FIGS. 3A and 3B, each of the kits 20A and 20B is provided with a projection 56 on a side surface thereof and adjacent to the front end with respect to the intended direction of kit insertion, the projections 56 on the two kits being identical with each other. The projections 56 are adapted to show the user whether the kit 20A or 20B has been accurately positioned in the housing 10. A microswitch 58 is mounted on the housing 10 to be turned on by the projection 56 of the kit 20A or 20B. Further, a lamp 60 (FIG. 1) is electrically connected to the microswitch 58. In this construction, so long as the kit 20A or 20B is accurately positioned in the housing 10, the microswitch 58 is actuated by the projection 56 to turn on the lamp 60 and, thereby, inform the operator of the appropriate positioning. If the kit 20A or 20B is inadequately positioned or is not loaded in the housing 10, the microswitch 58 and, therefore, the lamp 60 will not be turned on.

As shown in FIG. 1, the lamp 60 in this particular embodiment is positioned in alignment with a reference edge 34*a* of the tray 34 with respect to the widthwise direction of sheets which may be stacked on the tray 34. Alternatively, the lamp 60 may be located in any other suitable position to show whether the kit 20A or 20B is present in the housing 10.

Further, it is desirable that which one of the kits 20A and 20B is loaded in the housing 10 be seen even with the cover 50 of the housing 10 closed. Such is implemented in this particular embodiments by use of lamps 62*a* and 62*b*. Specifically, the lamps 62*a* and 62*b* are mounted on the housing 10 adjacent to the sheet feed tray 34 and at spaced positions which respectively are associated with the lengths of the kits 20A and 20B with the reference edge 34*a* of the tray 34 as a reference. Microswitches 64*a* and 64*b* respectively are electrically connected to the lamps 62*a* and 62*b* to turn them on when turned on and, naturally, only when the microswitch 58 is turned on. The microswitches 64*a* and 64*b* are arranged at spaced locations in the intended direction of kit insertion in matching relation with the different lengths of the kits 20A and 20B. The kit 20A includes a projection 66a capable of turning on the microswitch 64 only, while the kit 20B includes a projection 66*b* capable of turning on the microswitch 64*b* only.

While the kit 20B is loaded in the housing 10 as shown in FIG. 3B, the microswitch 64*b* is turned on by the projection 66*b* to turn on the lamp 62*b* so that one can recognize the situation. Likewise, while the kit 20A is loaded in the housing 10 as shown in FIG. 3A, the microswitch 64*a* is actuated by the projection 60*a* to turn on the lamp 62*a*. Particularly, the lamps 62*a* and 62*b* are located in the vicinity of the sheet feed tray 34 and assigned, respectively, to a B4 format position and an A5 format position with the reference edge 34*a* as a reference, allowing one to readily see the size of sheets which should be loaded on the tray 34 or could be used.

While the illustrative embodiment has been applied to a printer which forms a latent image by means of the optical writing device 30, it is similarly applicable to a copier of the kind which uses a glass platen for loading a document, optics inclusive of a document illuminating device and an imaging device, etc.

In summary, it will be seen that the present invention provides a cost-effective image forming apparatus which allows a plurality of differently dimensioned image forming kits to be selectively loaded in a housing of the apparatus depending upon a desired image size. The apparatus of the invention reduces much of waste considering the costs of photoconductive element and others.

Various modifications will become possible for those skilled in the art after receiving the teachings of the present disclosure without departing from the scope thereof.

What is claimed is:

1. An image forming apparatus for providing an image on a photoconductive element, comprising:

a body which constitutes a housing; and a plurality of image forming kits selectively and removably loaded in said housing for each forming an image of a predetermined maximum size which differs from a predetermined maximum size or sizes assigned to the other kit or kits, each of said kits being provided in a cartridge configuration and including at least a photoconductive element therein.

2. An image forming apparatus as claimed in claim 1, wherein the body comprises a top wall, a bottom wall, a front wall, a rear wall, a right side wall, and a left side walls.

3. An image forming apparatus as claimed in claim 2, wherein the body further comprises guide means for guiding a selected one of the kits into the housing.

4. An image forming apparatus as claimed in claim 3, wherein the guide means comprises two guide rails each of which is supported by the front wall at one end and by the rear wall at the other end.

5. An image forming apparatus as claimed in claim 1, wherein each of the kits comprises a casing for accommodating the photoconductive element.

6. An image forming apparatus as claimed in claim 5, wherein each of the kits further comprises a charger, a developing unit and a cleaning unit which are arranged around the photoconductive element in the casing.

7. An image forming apparatus as claimed in claim 6, wherein the developing unit comprises a hopper for storing a developer, and a developing roller for supplying the developer to the photoconductive element.

8. An image forming apparatus as claimed in claim 5, wherein the casing is provided with a slit having a length which is associated with the maximum size, the apparatus further comprising optical writing means which is positioned to face the photoconductive element through said slit.

9. An image forming apparatus as claimed in claim 5, wherein the casing comprises a first projection which is so located as to protrude into a first fixing position in the housing when the kit is loaded in the housing.

10. An image forming apparatus as claimed in claim 9, further comprising a first microswitch which is turned on when pressed by the first projection which has reached the first fixing position.

11. An image forming apparatus as claimed in claim 10, further comprising a first lamp installed in the body to turn on when the first microswitch is turned on.

12. An image forming apparatus as claimed in claim 10, wherein the casing further comprises a second projection which protrudes into a second fixing position in the housing when the kit is loaded in the housing.

13. An image forming apparatus as claimed in claim 12, wherein the position of the second projection on the casing is determined by the maximum image size.

14. An image forming apparatus as claimed in claim 13, further comprising a second microswitch which is turned on when depressed by the second projection which has reached the second fixing position.

15. An image forming apparatus as claimed in claim 14, further comprising a second lamp installed in the body to turn on when the second microswitch is turned on.

16. An image forming apparatus as claimed in claim 15, wherein the body comprises a top wall, a bottom wall, a front wall, a rear wall, a right side wall and a left side wall, the apparatus further comprising sheet feed means arranged adjacent to said right side wall and sheet discharge means arranged adjacent to the left side wall.

17. An image forming apparatus as claimed in claim 16, wherein the right side wall is formed with an elongate slot in a lower portion thereof, the sheet feed means comprising a sheet feed tray which is mouned in the body through said slot of the right side wall.

18. An image forming apparatus as claimed in claim 17, wherein the second lamp is positioned on an external surface of the right side wall above the sheet feed tray and adjacent to the slot.

* * * * *